US006259366B1

(12) United States Patent
Lindskog et al.

(10) Patent No.: US 6,259,366 B1
(45) Date of Patent: Jul. 10, 2001

(54) METHOD AND DEVICE FOR DESTRUCTION OF OBJECTS

(75) Inventors: Kjell Lindskog, Skellefteå ; Ola Friström, Umeå, both of (SE)

(73) Assignee: SOS Security Owbe System AB, Skellefteå (SE)

( * ) Notice: Subject to any disclaimer, the term of this patent is extended or adjusted under 35 U.S.C. 154(b) by 0 days.

(21) Appl. No.: 09/227,427

(22) Filed: Jan. 8, 1999

Related U.S. Application Data

(63) Continuation-in-part of application No. PCT/SE97/01237, filed on Jul. 6, 1997.

(30) Foreign Application Priority Data

Jul. 10, 1996 (SE) ..... 9602732

(51) Int. Cl.[7] ..... G08B 13/14

(52) U.S. Cl. ..... 340/568.7; 340/568.1; 340/571; 109/25

(58) Field of Search ..... 340/568.1, 568.7, 340/571; 109/25

(56) References Cited

U.S. PATENT DOCUMENTS

| | | | | |
|---|---|---|---|---|
| 4,607,579 | | 8/1986 | Stenild | 109/25 |
| 4,712,489 | | 12/1987 | Levavasseur | 109/25 |
| 4,799,435 | * | 1/1989 | Boutroy | 109/25 |
| 4,852,502 | * | 8/1989 | Klingberg et al. | 109/25 |
| 4,942,831 | * | 7/1990 | Tel | 109/29 |
| 5,196,828 | * | 3/1993 | Keniston | 340/571 |
| 5,485,143 | * | 1/1996 | Keniston | 340/568 |
| 5,537,938 | * | 7/1996 | Lopez, Jr. | 109/25 |

FOREIGN PATENT DOCUMENTS

| | | | |
|---|---|---|---|
| 421548 | | 1/1982 | (SE) . |
| 436440 | | 12/1984 | (SE) . |
| 9528542 | | 10/1995 | (WO) . |
| WO98/28542 | * | 10/1995 | (WO) . |

* cited by examiner

*Primary Examiner*—Benjamin C. Lee
(74) *Attorney, Agent, or Firm*—Nils H. Ljungman & Associates

(57) ABSTRACT

Method and device for destruction of objects stored in an alarm-protected security container. There is used a destructive agent which is distributed over the object or objects when the alarm is triggered, so as to mark and/or destroy the object/objects. There is also used a destructive device which includes an explosive agent that acts at least partially on the object/objects when the alarm is triggered. The device includes a channel whose opening faces towards the object/objects. The destructive agent is encapsulated in the channel and the explosive agent is disposed adjacent the channel. The channel has a generally U-shaped cross section and includes end-walls.

20 Claims, 4 Drawing Sheets

FIG. 1
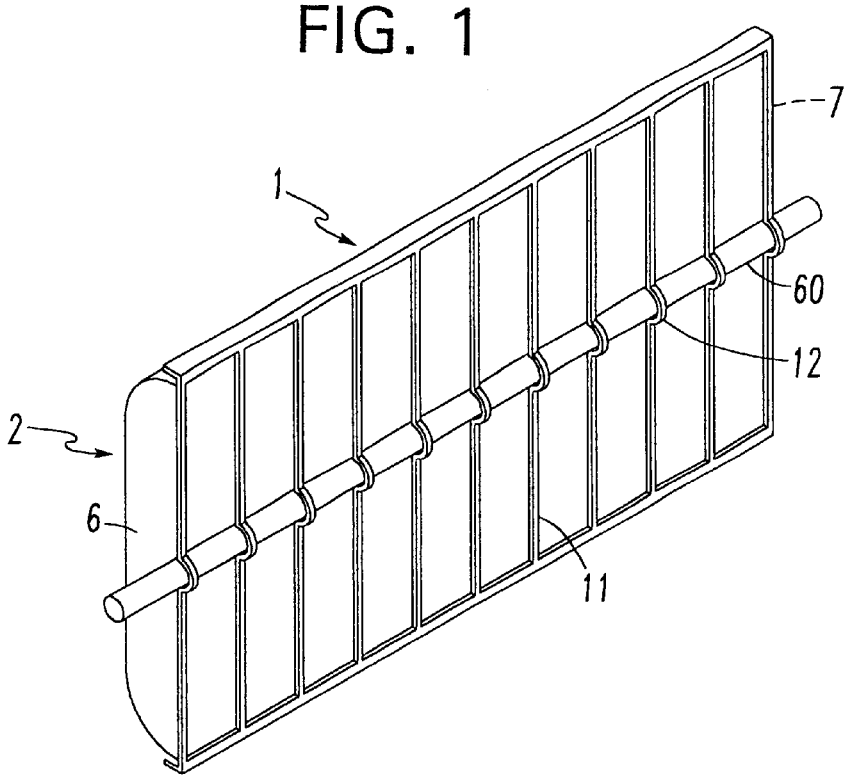
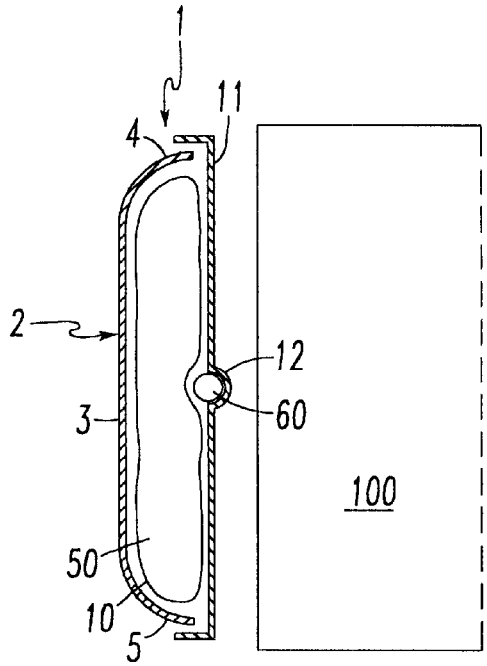
FIG. 2

FIG. 3
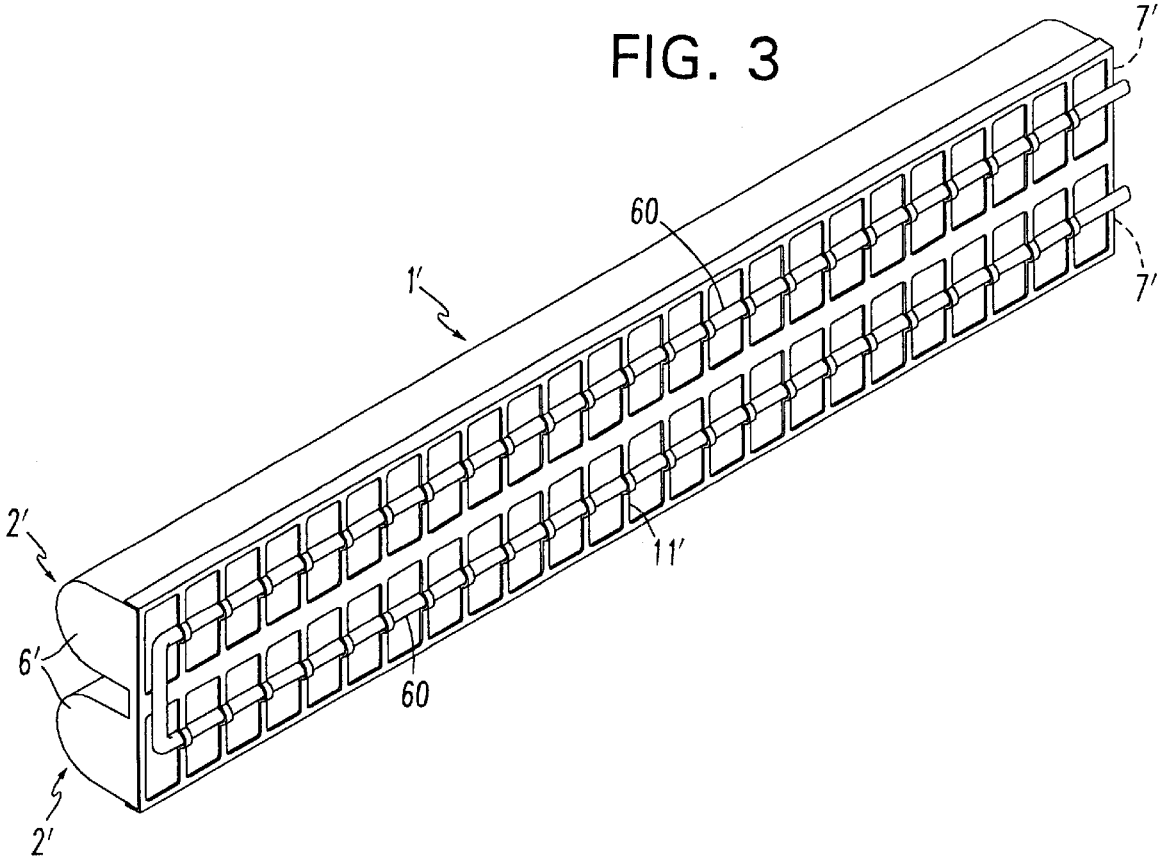
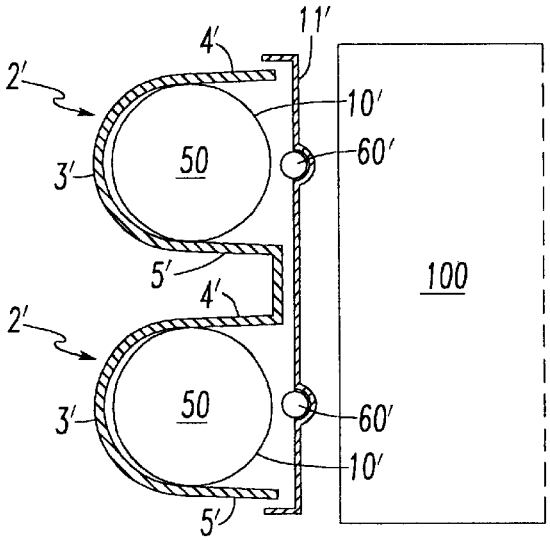
FIG. 4

METHOD AND DEVICE FOR DESTRUCTION OF OBJECTS

CONTINUING APPLICATION DATA

This application is Continuation-In-Part application of International Application No. PCT/SE97/01237, filed Jul. 6, 1997, which claims priority from Sweden Patent Application No.: 9602732-1, filed Jul. 10, 1996. International Application No. PCT/SE97/01237 was pending as of the filing date of the present U.S. application and the U.S. was an elected state in the International Application No. PCT/SE97/01237.

BACKGROUND OF THE INVENTION

1. Field of the Invention

The present invention relates to a method of destroying objects stored in a security container that can include an alarm device, wherewith the method can comprise the use of a destructive agent which ids distributed over the object or objects when said alarm device is triggered, such as to mark and/or destroy the object/objects, and wherewith there can be used a destructive device that includes an explosive agent which acts at least partially on the object/objects when said alarm device is triggered. The invention also relates to a device for carrying out the method.

2. Background Information

Security containers for the transportation of valuables, such as banknotes for instance, will normally contain a destructive device in the form of dye releasing cassettes or ampoules that are activated to release a dye when the security container is manipulated unlawfully, therewith colouring or otherwise destroying the contents of the container.

When the security container is filled with sealed, plastic envelopes for instance, it is very difficult to achieve satisfactory colouring of the contents of the envelopes, for instance banknotes.

OBJECT OF THE INVENTION

An object of the present invention is to provide a method and a device which will cause destruction of the objects or articles in the security container in a particularly effective manner. This object is achieved with a method and a device having the characteristic features set forth in herein.

Some of the advantages afforded by the present invention are listed below.

SUMMARY OF THE INVENTION

The inventive method and device cause the generation of an impact wave which splits open the envelopes/wrappings and/or the bundles of banknotes or other articles, such as to expose a very large surface area to the destructive agent.

The destructive agent is also distributed highly effectively.

The inventive device may, for instance, accommodate both single-component and multi-component destructive agents of mutually different types. Agents that will destroy or render useless magnetic tapes, diskettes and other information media may, of course, be used in the inventive device.

The inventive device is not limited to any particular size or dimensions and is adapted to the specifications required.

The inventive device also has technical and economical advantages.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than on patentably and non-obviously distinct invention, and maintain that this application may include more than on patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention will now be described in more detail with reference to exemplifying embodiments thereof and also with reference to the accompanying drawings, in which FIG. 1 is a schematic, perspective view of a first embodiment of an inventive destructive device;

FIG. 2 is a schematic cross-sectional view of the device shown in FIG. 1;

FIG. 3 is a schematic, perspective view of a second embodiment of an inventive destructive device; and FIG. 4 is a schematic cross-sectional view of the device shown in FIG. 3.

DESCRIPTION OF THE PREFERRED EMBODIMENT

Figure 5:
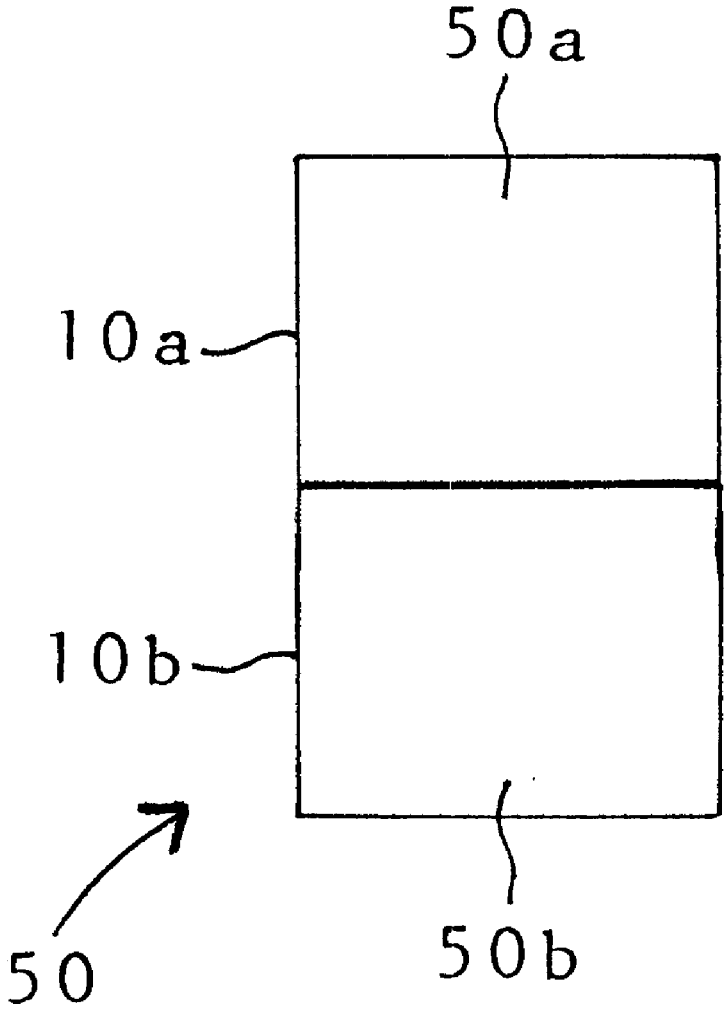
FIG. 5 shows one possible embodiment of a multi-component destructive agent.

It will be apparent from FIGS. 1 and 2 that the inventive, destructive device 1 includes a channel 2 which, when in use, faces towards the object 100 which the device is intended to destroy in the event of unlawful or unauthorized manipulation. The channel 2 will preferably have a generally U-shaped cross-section, including a bottom 3, two side-parts 4, 5 and two end-walls 6, 7. The channel 2 may be made of fibreglass reinforced plastic or of aluminum, for instance.

Disposed within the channel 2 is a casing which contains a destructive agent 50 and which has the form of an end-sealed hose 10. The hose 10 may be comprised of plastic foil and the destructive agent may be a single-component liquid or a dye of pronounced colour. The hose 10 filled with said destructive agent is held in position by a grid or grating 11, which is attached, preferably either glued or screwed firmly to the channel 2, for instance. Disposed between the hose 10 and the grating 11 is a string of explosive agent 60. The string of explosive agent 60 is accommodated in an outwardly bulged part 12 of the grating 11. The length and breadth dimensions of the casing 10 coincide generally with the inner dimensions of the channel 2, so as to enable the channel 2 to be filled effectively. The grating 11 will conveniently cover the whole of the channel 2, and the string of explosive agent 60 will conveniently extend along the full length of said channel 2.

The explosive agent 60 may have the form of an elongated, optionally plastic-encapsulated, pentyl fuse, although other explosive agents are, of course, conceivable.

When wishing to use a two-component destructive agent, the end-sealed tube 10 is divided into two parts, and so on. The hose 10 may, at times, be omitted, when electing to provide the channel 2 with a thin cover or lid, for instance a foil lid, so as to enclose the destructive agent in the channel 2.

FIGS. 3 and 4 illustrate an alternative embodiment of a destructive device 1', in which two channels 2' are juxtaposed and covered with a common grating 11'. Each of the channels 2' contains a respective hose 10' filled with destructive agent. A string 60 of explosive agent is disposed between the hoses 10' and the common grating 11', as evident from FIGS. 3 and 4. The channels 2' have a generally U-shaped cross-section and are relatively deep. Each of the channels 2' has a bottom 3', two side-parts 4', 5' and two end-walls 6', 7'.

The function and use of the inventive destructive device will now be described in more detail, with a starting point from the stage in which the destructive device 1 is placed in an alarm-protected security container and the explosive agent 60 is connected to the alarm device mounted in the container. The length of the destructive device 1 will preferably be the maximum length permitted by the security container, and the destructive device will be placed as close to the objects 100 as is possible to ensure necessary destruction of the objects, wherewith the channel opening faces towards the objects 100, which may comprise stacks or bundles of sealed plastic envelopes containing banknotes.

The following events take place when the destructive device 1 is activated/triggered by the alarm device.

The explosive agent 60 acts in two ways. The explosive agent 60 acts directly on the objects 100 and will open any seals present and physically deform, e.g., banknotes or documents. The explosive agent 60 punctures the hose or casing 10 of the destructive agent 50 and propels the agent into contact with the objects 100. The cross-sectional shape of the channel 2 contributes towards effectively guiding the destructive agent 50 towards the objects 100.

The embodiment illustrated in FIGS. 3 and 4 also functions in the aforedescribed manner and is used in the same way.

The components of a multi-component destructive agent will be mixed very effectively by the explosive force generated, prior to said components reaching the objects 100.

FIG. 5 shows schematically one possible embodiment of a multi-component destructive agent 50, wherein the destructive device 1 can contain, for example, two hoses or casings 10*a*, 10*b*, each containing one component 50*a*, 50*b* of a multi-component destructive agent 50. Which components 50*a*, 50*b* can be mixed by the explosive force generated, prior to the components reaching the objects 100.

The configuration of the channel 2 is very significant to the distribution of the destructive agent.

Thus, the inventive channel presents an opening which functions to control distribution of the destructive agent. The width of the channel opening and the configuration of the channel, and the position of the explosive agent relative to said channel, all have an effect on the pattern of distribution of the destructive agent.

In one advantageous embodiment of the invention, the cross-sectional shape of the channel will correspond to that of a conventional vehicle headlamp, such that the channel will, in principle, function analogously with a headlamp reflector. In this respect, the explosive agent may be placed in what can be called the focal point of the channel, therewith achieving extraordinarily effective spreading of the destructive agent through the medium of said channel.

It will be understood that the structural components of the inventive device 1 can be modified and varied in several respects.

For instance, the hose or casing 10 may be divided into a plurality of sub-casings along the channel 2.

The grating 11 may be replaced with plastic or metal foil for instance, in which case the string of explosive agent may be glued to the foil. If desired, the aforesaid foil can be used to encapsulate the destructive agent in the channel.

It will be observed that the placement of the string of explosive agent between the channel filling material, e.g. encapsulated filling material (destructive agent) and the object 100 enables the object/articles 100 to be burst apart prior to expulsion of the channel or bowl of said reflector-like construction.

Figure 7:
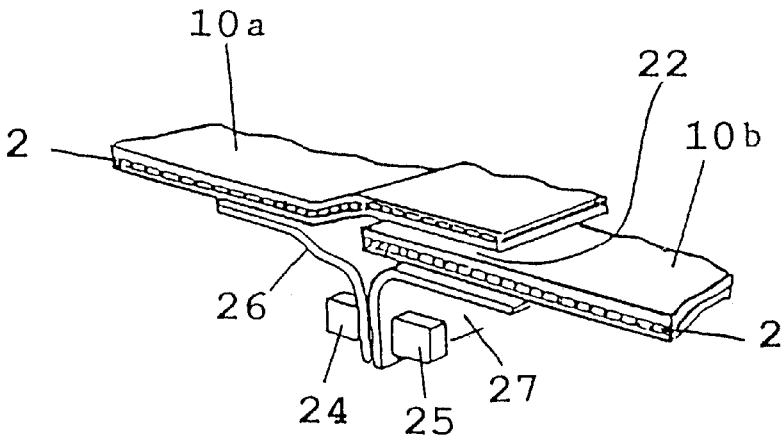
FIGS. 6 and 7 show one possible embodiment of a security container.
Figure 6:
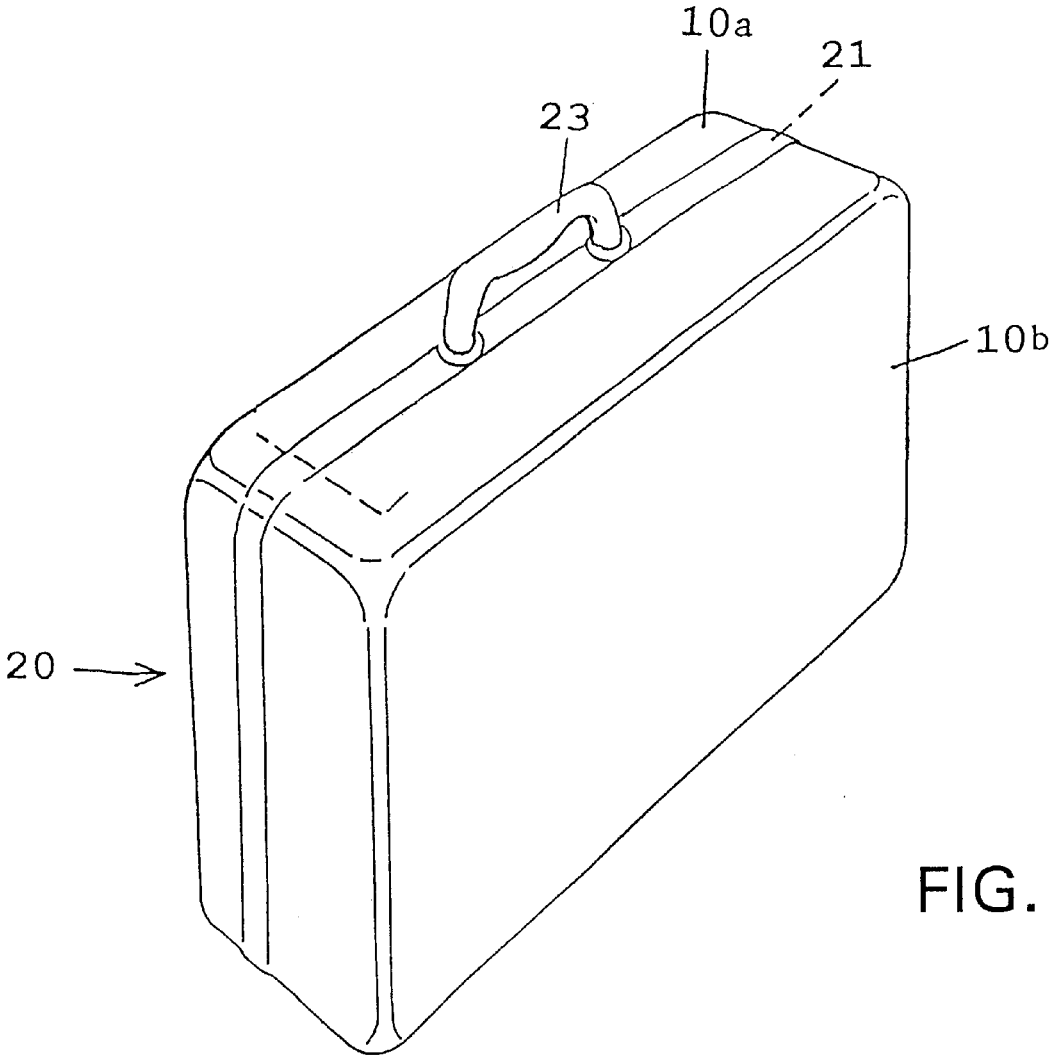

FIGS. 6 and 7 show one possible example of a transportable security container 120 with which the inventive destructive device may possibly be used. The case 120 illustrated in FIG. 6 can be constructed from two shaped laminate sections 10*a*, 10*b*, the sections being so configured that when the case is closed, the laminate sections will overlap in an overlap zone 21 which presents the smallest possible gap or clearance 22 between the overlapping parts. The case is typically provided with a handle 23 glued, for example, to the outside of the case, and also with hinge means, locking devices, etc., which can be mounted in a manner which excludes the necessity of perforating the laminate sections. A number of electrical contacts or detectors 24 and 25 can be mounted immediately inwards of the overlapping zone 21, the devices 24 being carried by a strip 26 bonded to the laminate section 10*a* and the devices 25 being carried by a further strip 27 glued to the other laminate section 10*b*. The strips 26 and 27 will preferably extend around the full perimeter of the container 20, and an appropriate number of electric contact devices 24, 25 are therewith mounted around the container perimeter. A cage is formed by mutually connecting the respective alarm mats 2 of the laminate sections 10*a* and 10*b* and the electrical contact devices 25 and 25, so as to form one or more electric signal circuits. The circuit or circuits is/are broken, resulting in the activation of the destructive device, when a thread 5, 5' in the mat 2 is fractured or cut as a result of attempting to make a hole in the container, and it will be understood from this that the mat 2 will preferably extend over the whole of the container surface. A mat overlap is also provided in the overlap zone 21. The signal circuit will also be broken when attempting to widen the gap 22, by bending apart the overlapping parts of respective laminate sections in an attempt to unlawfully force the container 20. When attempting to widen the gap, the space between the devices 24 and 25 will alter and therewith break the electric circuit. In at least one embodiment, it is possible that an electronic unit or device can be utilized to activate the destructive device in response to a break in the electric circuit.

It will therefore be understood that the invention is not restricted to the illustrated and described embodiment thereof and that modifications can be made within the scope of the following Claims and features.

One feature of the invention resides broadly in a method of destroying objects stored in a security container that includes an alarm device, wherewith the method comprises the use of a destructive agent (50) which is distributed over the object or objects (100) when the alarm device is triggered, such as to mark and/or destroy the object/objects, and wherewith there is used a destructive device (1; 1') that includes an explosive agent (60) which acts at least partially on the object/objects (100) when the alarm device is triggered, characterized by encapsulating the destructive agent (50) in a channel (2; 2') whose opening faces towards the object/objects (100); and by placing the explosive agent (60) adjacent the channel.

Another feature of the invention resides broadly in the method of destroying objects stored in a security container by using a channel (2; 2') which is generally U-shaped in cross-section and which includes end-walls (6, 7; 6', 7').

Yet another feature of the invention resides broadly in a device for destroying objects stored in an alarm-fitted security container, the device (1; 1') including a destructive agent (50) which is distributed over the object or objects (100) when an alarm is triggered, such as to mark and/or destroy the object/objects, and wherewith the destructive device (1; 1') includes an explosive agent (60) which acts at least partially on the object/objects (100), characterized in that the device (1; 1') includes a channel (2; 2') whose opening faces towards the object/objects (100); in that the destructive agent (50) is encapsulated in the channel (2; 2'); and in that the explosive agent (60) is disposed adjacent the channel.

Still another feature of the invention resides broadly in the device characterized in that the channel (2; 2') has a generally U-shaped cross-section; and in that the channel (2; 2') has end-walls (6, 7; 6', 7').

A further feature of the invention resides broadly in the device characterized in that the channel (2; 2') opening is covered with a grid or grating structure (11; 11').

Another feature of the invention resides broadly in the device characterized in that the explosive agent (60) is a string of explosives.

Yet another feature of the invention resides broadly in the device characterized in that the explosive agent (60) is a pentyl fuse.

Still another feature of the invention resides broadly in the device characterized in that the destructive agent (50) is a single-component liquid encapsulated in a casing (10; 10').

A further feature of the invention resides broadly in the device characterized in that the destructive agent (50) is a two-component liquid; and in that each liquid component is encapsulated in a separate casing.

Another feature of the invention resides broadly in the device characterized in that the casing element (10; 10') encasing the destructive agent is comprised of foil, for instance plastic foil.

Examples of methods and devices, or components thereof, for destruction of objects, which may be used by and/or in conjunction with the present invention can be found in U.S. Pat. No. 5,775,235, which issued on Jul. 7, 1998 to inventors Kjell Lindskog and O. Fristrom, entitled "Method and Device for Destruction of Objects" and which patent, as well as all the patents and documents referenced or cited within this patent, are hereby incorporated by reference as if set forth in their entirety herein.

Further examples of a structure and methods relating to a security container, casing or room or space, which comprise an alarm system, which may be used by and/or in conjunction with the present invention can be found in U.S. patent application No. 09/118,355 filed on Jul. 17, 1998, having inventor K. Lindskog, this application, as well as the documents and patents referenced or cited therein, are hereby incorporated by reference as if set forth in their entirety herein.

Some examples of alarms, alarm devices, or alarm circuits or components thereof, which could possibly be utilized or adapted for use in one embodiment of the present invention can be found in the following U.S. Patents: U.S. Pat. No. 5,831,531, issued on Nov. 3, 1998 to inventor Tuttle; and No. 5,775,235, issued on Jul. 7, 1998 to inventors Lindskog, et al.; and No. 5,686,909, issued on Nov. 11, 1997 to inventor Steinhauser; and No. 5,554,833, issued on Sep. 10, 1996 to inventor Johnson; and No. 5,548,915, issued on Aug. 27, 1996 to inventors Szarmach, et al.; and No. 5,191,314, issued on Mar. 2, 1993 to inventors Ackerman, et al.; and No. 4,300,130, issued on Nov. 10, 1981 to inventors Fotheringham, et al.; and No. 3,967,239, issued on Jun. 29, 1976 to inventor Steele.

Some examples of explosive devices or explosive substances which could possibly be utilized or adapted for use in one embodiment of the present invention can be found in the following U.S. Patents: U.S. Pat. No. 5,775,235, issued on Jul. 7, 1998 to inventors Lindskog, et al.; and No. 5,600,086, issued on Feb. 4, 1997 to inventor Lemmonier; and No. 5,505,631, issued on Apr. 9, 1996 to inventors Schauer, et al.; and No. 5,503,077, issued on Apr. 2, 1996 to inventor Motley; and No. 5,485,788, issued on Jan. 23, 1996 to inventor Corney; and No. 5,035,843, issued on Jul. 30, 1991 to inventor Schmid.

The components disclosed in the various publications, disclosed or incorporated by reference herein, may be used in the embodiments of the present invention, as well as, equivalents thereof.

The appended drawings in their entirety, including all dimensions, proportions and/or shapes in at least on embodiment of the invention, are accurate and to scale and are hereby included by reference into this specification.

All, or substantially all, of the components and methods of the various embodiments may be used with at least one embodiment of all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Sweden Patent Application No. 9602732-1, filed Jul. 10, 1996, having inventors Kjell LINDSKOG and Ola FRISTROM, and Laid-open Swedish Patent Application No. 9602732.1, if any, and Published Swedish Patent Application No. 9602732.1, if any, and International Application No. PCT/SE97/01237, filed Jul. 6, 1997, and international Publication No. WO 98/01646 published on Jan. 15, 1998, as well as their published equivalents, and other equivalents or corresponding applications, if any, in corresponding cases in Sweden and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A method of destroying objects stored in a security container that includes an alarm device, wherewith the method comprises the use of a destructive agent which is distributed over the object or objects when said alarm device is triggered, such as to mark and/or destroy the object/objects, and wherewith there is used a destructive device that includes an explosive agent which acts at least partially on the object/objects when said alarm device is triggered, wherein the destructive agent is encapsulated in a channel whose opening faces towards the object/objects; and by placing said explosive agent adjacent the channel.

2. The method according to claim 1, wherein said channel is generally U-shaped in cross-section and includes end-walls.

3. A device for destroying objects stored in an alarm-fitted security container, said device including a destructive agent which is distributed over the object or objects when an alarm is triggered, such as to mark and/or destroy the object/objects, and wherewith the destructive device includes an explosive agent which acts at least partially on the object/objects, wherein the device includes a channel whose opening faces towards the object/objects; in that the destructive agent is encapsulated in the channel; and in that the explosive agent is disposed adjacent said channel.

4. The device according to claim 3, wherein the channel has a generally U-shaped cross-section; and said channel has end-walls.

5. The device according the claim 4, wherein the channel opening is covered with a grid or grating structure.

6. A device according to claim 5, wherein the explosive agent is a string of explosives.

7. A device according to claim 6, wherein the explosive agent is a pentyl fuse.

8. A device according to, claim 7, wherein the destructive agent is a single-component liquid encapsulated in a casing.

9. A device according to claim 7, wherein the destructive agent is a two-component liquid; and in that each liquid component is encapsulated in a separate casing.

10. A device according to claim 9, wherein the casing encasing the destructive agent is comprised of plastic foil.

11. The device according to claim 8, wherein the casing encasing the destructive agent is comprised of foil.

12. The device according to claim 6, wherein the destructive agent is a two-component liquid; and in that each liquid component is encapsulated in a separate casing.

13. The device according to claim 5, wherein the explosive agent is a pentyl fuse.

14. The device according to claim 5, wherein the destructive agent is a single-component liquid encapsulated in a casing.

15. The device according to claim 4, wherein the explosive agent is a string of explosives.

16. The device according to claim 3, wherein the channel opening is covered with a grid or grating structure.

17. The device according to claim 3, wherein the explosive agent is a string of explosives.

18. The device according to claim 3, wherein the explosive agent is a pentyl fuse.

19. The device according to claim 3, wherein the destructive agent is a single-component liquid encapsulated in a casing.

20. The device according to claim 3, wherein the destructive agent is a two-component liquid; and in that each liquid component is encapsulated in a separate casing.

* * * * *

UNITED STATES PATENT AND TRADEMARK OFFICE

CERTIFICATE OF CORRECTION

PATENT NO. : 6,259,366 B1
DATED : July 10, 2001
INVENTOR(S) : Kjell Lindskog and Ola Friström It is certified that error appears in the above-identified patent and that said Letters Patent is hereby corrected as shown below:

Title page,
Item [73], after "Security", delete "Owbe" and substitute -- Qube --.

Column 2,
Line 5, after "than" delete "on" and substitute -- one --.
Line 7, after "than" delete "on" and substitute -- one --.

Column 4,
Line 36, after "devices" delete the first occurrence of "25" and substitute -- 24 --.

Column 6,
Line 31, after "embodiment" delete "of" and substitute -- or --.

Signed and Sealed this

Seventh Day of May, 2002

*Attest:*

*Attesting Officer*

JAMES E. ROGAN
*Director of the United States Patent and Trademark Office*